United States Patent [19]

Matta et al.

[11] 4,200,036

[45] Apr. 29, 1980

[54] VENTILATION SYSTEM FOR AUTOMATED MINING MACHINES

[75] Inventors: Joseph E. Matta, Bel Air, Md.; Fred N. Kissell, Pittsburgh, Pa.

[73] Assignee: The United States of America as represented by the Secretary of the Interior, Washington, D.C.

[21] Appl. No.: 958,592

[22] Filed: Nov. 7, 1978

[51] Int. Cl.[2] ..... E21F 1/08

[52] U.S. Cl. ..... 98/50; 299/1; 299/12

[58] Field of Search ..... 98/49, 50, 115 LH; 299/12, 4, 19, 64

[56] References Cited

U.S. PATENT DOCUMENTS

| | | | |
|---|---|---|---|
| 1,917,439 | 7/1933 | Driggs | 98/50 |
| 3,333,896 | 8/1967 | Diamanti | 98/50 X |
| 3,712,678 | 1/1973 | Amoroso | 299/12 X |

FOREIGN PATENT DOCUMENTS

| | | | |
|---|---|---|---|
| 581067 | 7/1933 | Fed. Rep. of Germany | 98/50 |
| 2635405 | 2/1978 | Fed. Rep. of Germany | 299/12 |
| 2745260 | 4/1978 | Fed. Rep. of Germany | 299/12 |
| 1275186 | 9/1961 | France | 98/50 |

OTHER PUBLICATIONS

Kebblish, John B., "Face Ventilation and Dust Control With Continuous Mining Machines", *Mining Congress Journal*, Jan. 1959, pp. 34–39, 299–312.

Lingo, Paul C., "Face Ventilation With Continuous Mining", *Mechanization*, Sep. 1962, pp. 39–43, 299–312.

*Primary Examiner*—Albert J. Makay
*Assistant Examiner*—Harold Joyce
*Attorney, Agent, or Firm*—Thomas Zack; Donald A. Gardiner

[57] ABSTRACT

A mine ventilation system and method are provided for continuously supplying fresher air to an automated mining machine located in a mine heading. A blower attached to a mining machine operates to suck fresher air into the heading from a tunnel with through ventilation and to exhaust the air out of the heading through a collapsible duct. A standby blower is provided which is activated should the machine blower not be functioning for whatever reason. This blower draws fresher air from the tunnel with through ventilation and blows it out through the collapsible duct, in a direction opposite to the normal air flow, and into the heading. The standby blower is located in the tunnel downstream of the heading and has an intake duct with an inlet upstream of the heading.

3 Claims, 1 Drawing Figure

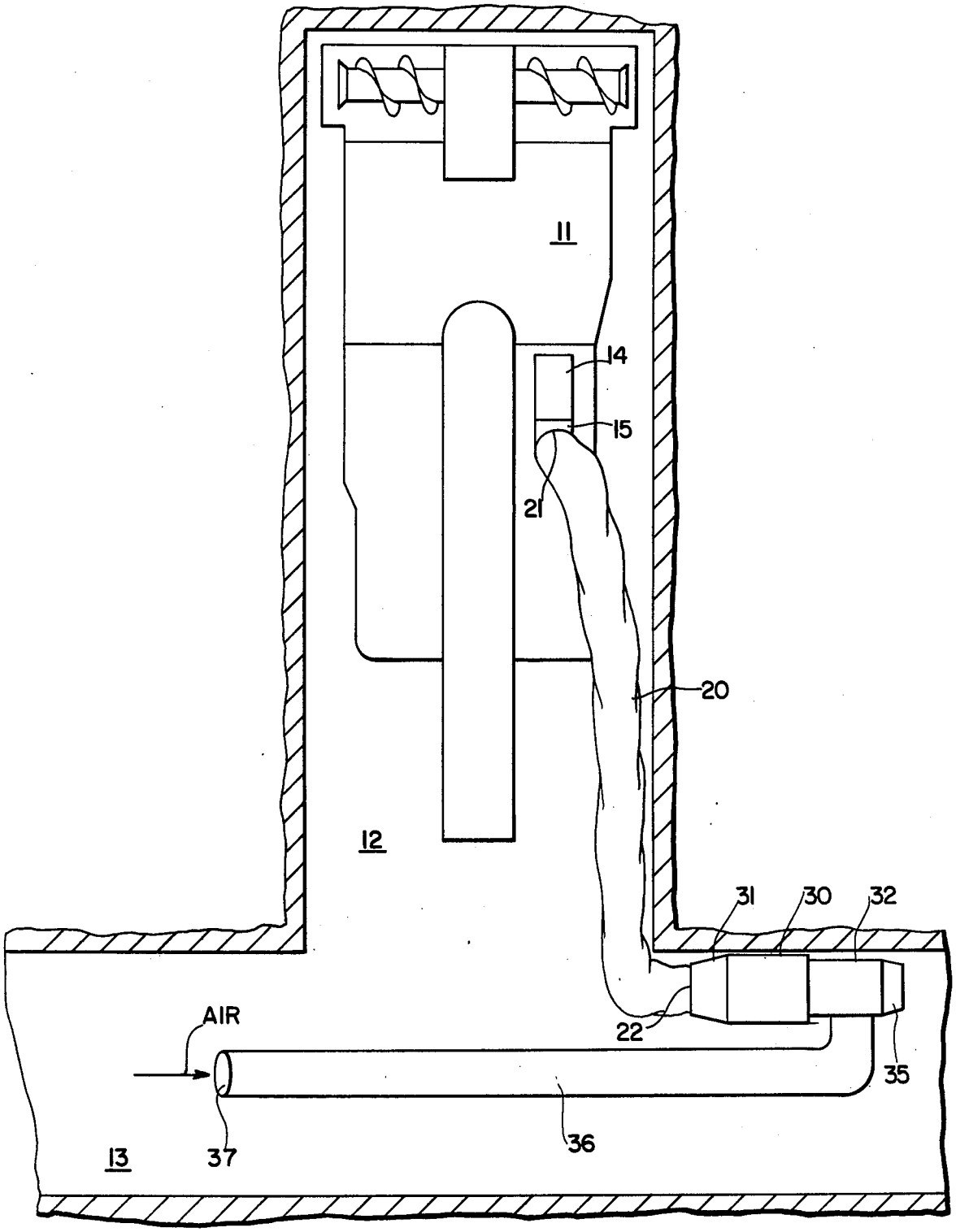
11
14
15
21
20
12
31
30
32
AIR
22
35
36
13
37

VENTILATION SYSTEM FOR AUTOMATED MINING MACHINES

FIELD OF THE INVENTION

This invention relates to method and apparatus for ventilation of a heading in a mine.

BACKGROUND OF THE INVENTION

Prior art systems for providing ventilation of heading characteristically contain a blower which is mounted on a mining machine. An example of a blower mounted on a mining machine is disclosed in U.S. Pat. No. 3,824,911 (Janelid et al). As disclosed in this patent, the blower sucks fresher air in along one wall and directs the air back out along another wall so that the two air currents are stratified. In a further prior art system, the so-called Automated Extraction System (AES), the air is blown out of the heading by means of collapsible tubing which runs from a blower on a machine to the downstream side of a tunnel with through ventilation.

There are a number of disadvantages to the prior art systems. First, when the electrical power to the machine is cut off for any reason, the blower on the machine stops functioning as well and the heading is then unventilated. Further, when the machine, and hence the blower, is moved out of the heading, the heading will also be unventilated. While both of these problems are currently solved by hanging so-called line curtain, this is a cumbersome and time consuming operation. In addition, hanging line curtain is also not a suitable solution for an automated, high production system. Thus, prior art systems do not provide a reliable and continuously operable system for providing fresher air to a heading. Furthermore, prior art systems do not provide immediate ventilation as soon as the blower on the machine stops blowing.

SUMMARY OF THE INVENTION

In accordance with the present invention, a method and apparatus for ventilating a heading or the like is provided which overcomes the above-mentioned disadvantages as well as other disadvantages of the prior art. The present invention also provides a means for ventilating a heading without any substantial interruption in the air supply.

Generally speaking, the present invention provides ventilation of a heading through the use of a separate standby blower or fan in addition to a machine blower or fan on a mining machine. A sensor controls the operation of the standby blower, the sensor acting to energize the standby blower whenever the machine blower is not functioning. The apparatus of the system of the invention includes a collapsible duct with an opening in the interior of the heading and another opening in a tunnel with through ventilation. This duct is used by both blowers. The machine blower on the mining machine exhausts air into the opening of the duct in the heading so that it passes through the duct and out of the opening in the tunnel in a conventional manner. On the other hand, the standby blower, when activated, pumps air through the duct in the opposite direction, causing fresher air to enter the opening of the duct in the tunnel and to exit the duct through the opening in the heading.

In a preferred embodiment of the present invention, a damper, in a first position thereof, together with an intake duct, provide a source of fresher air for the standby blower. In a second position thereof, the damper blocks the flow of air through the intake duct and directs the air from the machine blower into the tunnel.

Other features and advantages of the present invention are stated in or apparent from the presently preferred embodimentsof the invention found hereinbelow.

BRIEF DESCRIPTION OF THE DRAWING

The single FIGURE in the drawings is a highly schematic representation of a cross-sectional view of a mine heading and tunnel containing a mining machine incorporating a ventilation system in accordance with the present invention.

DETAILED DESCRIPTION OF THE PREFERRED EMBODIMENTS

With reference now to the single figure in the drawings, a presently preferrred embodiment of the present invention is depicted as used in a mine. A mining machine 11 is shown in a heading 12 which extends from a tunnel 13 which has through ventilation. The term "heading" in this application is used to refer to any mine tunnel or the like which is closed at one end so that there is no through ventilation. A machine blower or fan 14, attached to mining machine 11, has a nozzle 15. Connected to nozzle 15 is a collapsible duct 20, such as cloth tubing. Collapsible duct 20 is removably attached to nozzle 15 at the proximal or heading end 21 of duct 20. The distal or tunnel end 22 of collapsible duct 20 is located in tunnel 13, downstream of heading 12. Connected in series with tunnel opening 22 is an airflow sensor 31, a standby blower fan 30, and a damper arrangement or damper 32. Damper 32 is movable between two positions and includes an outlet duct 35 and a rigid intake duct 36. Intake duct 36 extends from damper 32 to an inlet 37 which is located upstream of heading 12.

Before proceeding, it is noted that a conventional mining machine would include a fan 14 and associated exhaust duct 20 and air would be drawn into heading 12 and exhausted into tunnel 13 through duct 20. Turning again to the mining machine shown in the drawings, the air moving system for ventilating the heading operates in the following manner. The machine blower 14, associated with mining machine 11 causes fresher air in turnnel 13 to be sucked into heading 12. As in a conventional system, this air is sucked around mining machine 11 and blown out nozzle 15 by machine blower 14. The air exiting nozzle 15 enters collapsible duct 20 through opening 21 which is attached to nozzle 15. The air exits collapsible duct 15 through the tunnel end 22 of duct 20 and passes into airflow sensor 21, standby blower 30, and damper means 32. Finally the air exits through outlet 35 into tunnel 13. The location of outlet duct 35 is far enough downstream from heading 12 to ensure that air exiting from outlet duct 35 will not be drawn back into heading 12 by machine blower 14.

When machine blower 15 is functioning properly, airflow sensor 22 maintains standby blower 30 in an off position so that air flows freely therepast. Damper 32 is positioned to direct all the air out of outlet duct 35, and to prevent any air passing through damper 32 from entering intake duct 36. It will be appreciated that if air passing through the damper 32 were able to enter intake duct 36, it might pass out of inlet 37 and again be drawn into heading 12.

In accordance with the present invention, when the mining machine 11 and attached machine blower 14 are removed from the heading, or when the machine blower 14 ceases to function for whatever reason, the air moving system operating to ventilate the heading operates in the following manner. In response to a lack of air being moved by machine blower 14 past airflow sensor 31, standby blower 30 is immediately activated. At the same time, damper 32 changes position so as to block the flow of air through outlet duct 35 and to allow the flow of air through intake duct 36. Standby blower 30 operates to cause air to flow through collapsible duct 20 in the opposite direction that is provided by machine blower 14. Standby blower 30 causes fresher air moving in tunnel 13 to enter inlet 37 and to travel through intake duct 36 and damper means 32. From standby blower 30, the air passes airflow sensor 31 and passes through collapsible duct 20. The fresher air then passes out of the heading end 21 of duct 20 through nozzle 15 and machine blower 14 and finally into heading 12. Once in heading 12, the air ventilates heading 12 and passes back to tunnel 13. It should be noted that inlet 37 is located a sufficient distance upstream of heading 12 to ensure that air which had already been used to ventilate heading 12 is not drawn into inlet 37. Also intake duct 36 is made from a rigid material so that it does not collapse when not in use, which collapse might prevent standby blower 30 from sucking air.

It is well appreciated that it would be possible to locate airflow sensor 31, standby blower 30, or damper means 32 at different positions rather than next to each other. Likewise, it would be possible to locate damper means 32 at a position upstream of heading 12. In that case, collapsible duct 36 would be very short and outlet duct 35 would have to extend to the downstream side of heading 12. Thus, although the invention has been described in detail with respect to an exemplary embodiment thereof, it will be understood by those skilled in the art that variations and modifications may be effected within the scope and spirit of the invention.

We claim:

1. An air moving system for ventilating an underground mine heading of the type in which a mining machine and associated machine blower are located in the heading and in which fresher air is normally sucked into the heading from a tunnel with through ventilation by the machine blower and then is blown out of the heading and back to the tunnel through a collapsible duct attached to the machine blower, wherein the improvement comprises:

a sensor for detecting when the machine blower is not blowing air through the collapsible duct;

a standby blower located in the tunnel and operatively responsive to the sensor for sucking fresher air from the tunnel through the collapsible duct into the heading in a direction opposite to that of the normal flow when the machine blower is not functioning; and an intake duct with an inlet upstream of the heading, for supplying fresh air to said standby blower; and a damper means for controlling movement of air, said damper means being movable from a first position wherein said damper means directs air downstream of the heading, to a second position wherein said damper means cause fresher air from said intake duct to be blown by said standby blower through the collapsible duct and then into the heading.

2. A ventilating system as claimed in claim 1 wherein said sensor is an airflow sensor.

3. A ventilating system as claimed in claim 1 wherein said standby blower and said sensor are located in the tunnel.

* * * * *